US005520195A

United States Patent [19]

Rizzoli et al.

[11] Patent Number: 5,520,195

[45] Date of Patent: May 28, 1996

[54] METHOD OF PRODUCING FILTER-TIPPED CIGARETTES

[75] Inventors: Salvatore Rizzoli, Bologna; Bruno Belvederi, S. Martino Di Monte S. Pietro, both of Italy

[73] Assignee: G.D Societa' per Azioni, Bologna, Italy

[21] Appl. No.: 231,335

[22] Filed: Apr. 22, 1994

[30] Foreign Application Priority Data

Apr. 23, 1993 [IT] Italy ..... BO93A0164

[51] Int. Cl.[6] ..... A24C 5/47

[52] U.S. Cl. ..... 131/94

[58] Field of Search ..... 131/94, 93, 27.1, 131/29, 32, 34, 58, 60

[56] References Cited

U.S. PATENT DOCUMENTS 2,952,105 9/1960 Schur .

4,614,198 9/1986 Hinchcliff et al. ..... 131/94

4,640,013 2/1987 Cristian ..... 131/94

4,848,371 7/1989 Belvederi ..... 131/94

FOREIGN PATENT DOCUMENTS 2126468 3/1984 United Kingdom ..... 131/94

*Primary Examiner*—Jennifer Bahr

*Attorney, Agent, or Firm*—Marshall, O'Toole, Gerstein, Murray & Borun

[57] ABSTRACT

On a filter assembly machine, a succession of groups, each including two cigarette portions, a double filter between the two cigarette portions, and a gummed strip connected integral with and projecting from the group, is fed by an input conveyor to a transfer station where each group is transferred into a respective seat on a rolling device with multiple rolling channels: each gummed strip being fed on to the respective group so as to project forwards from the group in the traveling direction of the input conveyor.

7 Claims, 2 Drawing Sheets

1
15
17
18
16
P3
6
9
8
19
10
13
24
22
2
23
19a
P1
37
37
14
20
9
36
12
14
35
38
9
7
23
25
21
8
4
5
9
27
14
3
29
27
29
34
26
P2
31
8
30

26a
33
32
33
34
28
32
30
31
9
30

METHOD OF PRODUCING FILTER-TIPPED CIGARETTES

BACKGROUND OF THE INVENTION

The present invention relates to a method of producing filter-tipped cigarettes.

Filter-tipped cigarettes are normally produced from double cigarettes, each formed by rolling a gummed strip of paper material about a group consisting of two cigarette portions separated axially by a filter twice as long as that of a finished filter-tipped cigarette.

The strips are normally rolled about said groups by means of a rolling device to which the groups are normally fed by an input roller with a number of peripheral seats. Each seat receives and retains by suction both a respective group, and a respective gummed strip with one end connected to the group, along a generating line of the group opposite the seat, and projecting rearwards from the group in relation to the rotation direction of the input roller.

U.S. Pat. No. 4,848,371 relates to a so-called "multiple-channel" rolling method.

Here and hereinafter, the term "multiple-channel rolling" is intended to mean a rolling method whereby each group is fed to a respective transfer conveyor by which it is fed along a respective rolling channel in turn traveling along a given path.

More specifically, as described in U.S. Pat. No. 4,848,371, the input roller transfers the groups successively to a central rolling device or drum substantially tangent to the input roller at a transfer station, and rotating, at a first given speed equal, at the transfer station, to that of the input roller, about an axis parallel to the rotation axis of the input roller. The central drum comprises a ring of peripheral transfer rollers, each mounted on the drum so as to rotate, in relation to the drum, about a respective axis parallel to the rotation axis of the drum, and so as to define, with a peripheral portion of the drum, a respective rolling channel moving at said first speed along a circular path. Each transfer roller presents a respective peripheral seat, which, by virtue of the central drum and the respective transfer roller rotating about their respective axes, travels through the transfer station together with and at the same speed as a corresponding seat on the input roller, and is supplied by the input roller with a respective group and strip, which it feeds along said respective rolling channel. At the end of the rolling operation, said seat receives the newly formed double cigarette and, in the same way as for pickup but in reverse, transfers it to a seat on an output roller.

The advantages of multiple-channel as compared with standard single-channel rolling are considerable in that the multiple channels not only provide for rendering rolling speed substantially independent of the traveling speed of the cigarettes, thus enabling faster production speeds, but also prevent total stoppage of the machine in the event of a cigarette being damaged inside the rolling channel.

One drawback of multiple-channel rolling, however, poses problems in the case of applications involving production speeds over and above a given limit. In fact, as a consequence of the manner, described above, in which each group and respective strip on the input roller are presented at the transfer station, the group is transferred to the seat on the respective transfer roller with the strip facing the latter seat and extending rearwards in relation to the traveling direction of the central drum.

Since the strip faces rearwards, winding of the strip about the respective group—which is performed by expelling the group from the seat on the transfer roller and rolling it on the surface of the transfer roller and on the respective strip along the respective rolling channel—can only be performed by rolling the group backwards in relation to the respective transfer roller, which in turn can only be achieved by rotating the transfer rollers in the same direction as the central drum, with the result that, at the transfer station, the speed of the central drum is added to that of the seat on each transfer roller, and the pitch of the seats on the input roller is much greater than the already relatively wide pitch of the axes of the transfer rollers about the periphery of the central drum.

The relatively wide pitch of the seats on the input roller, and consequently also on the output roller, poses serious drawbacks in that, on the one hand, at high production speeds, the traveling speeds of the cigarettes up- and downstream from the rolling drum are practically unsustainable, and, on the other, a relatively drastic and hence relatively complex pitch reduction is required along the filter assembly machine, prior to feeding the cigarettes to the input conveyor of the packing machine.

SUMMARY OF THE INVENTION

It is an object of the present invention to provide a multiple-channel rolling method designed to overcome the aforementioned drawbacks.

According to the present invention, there is provided a method of producing filter-tipped cigarettes, the method comprising stages consisting in feeding, by means of an input conveyor and in a given direction along a first given path, a succession of groups, each comprising two cigarette portions, a double filter between the two cigarette portions, and a gummed strip connected integral with, along a generating line of, and projecting from, said group; and successively transferring said groups into respective seats on a rolling device of the type presenting multiple rolling channels; the rolling device feeding said seats along a second path tangent to the first path at a transfer station; characterized by the fact that each said gummed strip is fed on to the respective group along a third path tangent to the first path, and in such a manner as to project frontwards from the group in said given direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
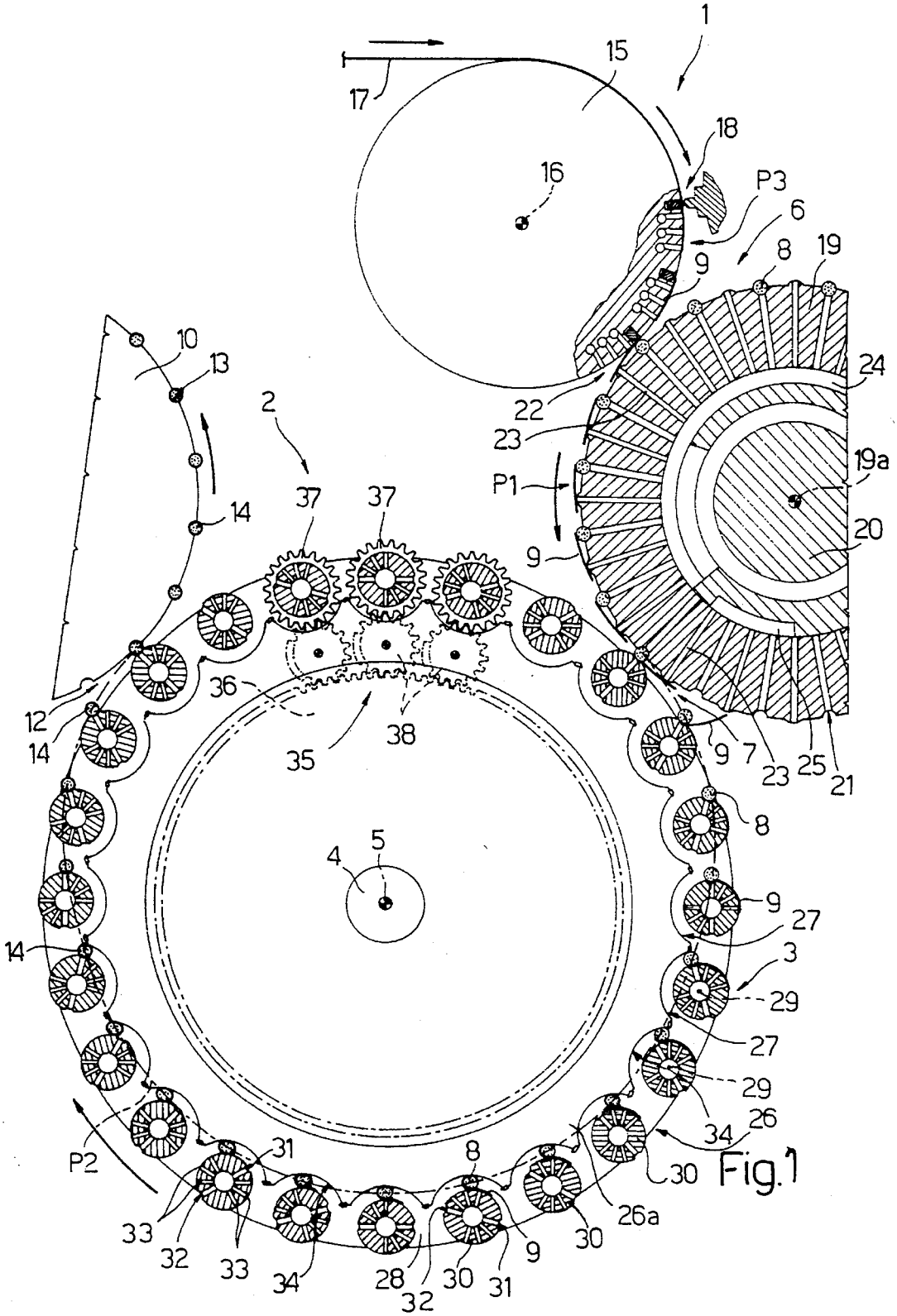
FIG. 1 shows a partial, schematic view of a portion of a filter assembly machine implementing the method according to the present invention.
Figure 2:
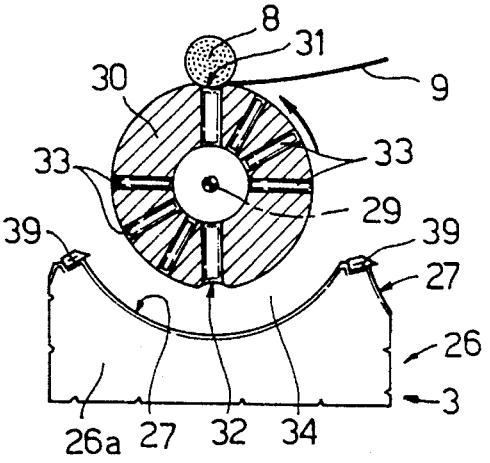
FIGS. 2 to 6 show larger-scale views of a detail in FIG. 1 in five different operating positions.

Number 1 in FIG. 1 indicates a filter assembly machine comprising a powered rolling unit 2 in turn comprising a central rolling drum 3 fitted in known manner (not shown) to a powered shaft 4 so as to rotate clockwise (in FIG. 1) at a given substantially constant speed about its axis 5.

Unit 2 also comprises a feed device 6 for successively feeding drum 3, at a transfer station 7 at a given point along the periphery of drum 3, with a number of groups 8, each defined (in known manner not shown) by two cigarette portions (not shown) separated by a double filter (not shown), and with a gummed strip 9 for joining the two cigarette portions to the double filter. Unit 2 also comprises an output roller 10 fitted to a respective powered shaft (not shown) parallel to shaft 4, tangent to drum 3 at an unloading station 12, and presenting a number of equally spaced peripheral seats 13, each for receiving and retaining by suction a respective double filter-tipped cigarette 14.

Device 6 comprises a first powered suction roller 15 rotating clockwise (in FIG. 1) about its axis 16 to feed a strip 17 of sheet material through a cutting station 18 where strip 17, gummed beforehand, is cut transversely into a succession of strips 9.

Device 6 also comprises a second powered roller 19 constituting the input roller of drum 3, and defined by a perforated tubular body supported in rotary and axially-fixed manner on a fixed central pneumatic distributor 20, and rotated, in relation to distributor 20 and anticlockwise (in FIG. 1) about its axis 19*a*, by a known drive device (not shown). As shown in FIG. 1, roller 19 is tangent to drum 3 at station 7, and presents a number of equally spaced peripheral seats 21, each for receiving a respective group 8.

Roller 19 is also tangent to roller 15 at a station 22 where strips 9 are fed on to roller 19 and connected in projecting manner to respective groups 8. More specifically, at station 22, each strip 9 is positioned with its rear end (in relation to the rotation direction of roller 19) gummed to respective group 8 along a generating line of group 8 opposite respective seat 21, and with its front end resting on a respective retaining element 23 located on the periphery of roller 19 and to the front of seat 21 (again in relation to the rotation direction of roller 19).

Distributor 20 comprises a suction chamber 24 communicating with all of seats 21 and all of elements 23 between station 7 and a station (not shown) at which groups 8 are fed on to roller 19; and a compressed air supply chamber 25 communicating with at least seat 21 and respective element 23 immediately downstream from station 7 in the rotation direction of roller 19.

As shown in FIG. 1, drum 3 is supplied by device 6 with a succession of groups 8 presenting respective strips 9 and fed by device 6 along a circular path P1 through station 7; and provides for connecting said cigarette portions and said filter (not shown) in each group 8 by winding respective strip 9 about the filter and the respective ends of the cigarette portions adjacent to the filter.

More specifically, drum 3 comprises a roller 26 fitted to shaft 4 so as to rotate clockwise (in FIG. 1), and presenting an end portion 26a with a number of cylindrical, outwardly-concave peripheral cavities 27 closed at one end by an annular shoulder 28 and having respective axes 29 equally spaced along shoulder 28 and parallel to axis 5. Drum 3 also comprises a ring of transfer rollers 30 connected to roller 26 so as to travel, with roller 26, along a circular path extending through stations 7 and 12, and so as to rotate, in relation to roller 26, about respective axes 29. Each roller 30 presents two peripheral, diametrically-opposed suction seats 31 and 32; and a number of suction holes 33 located behind each seat 31, 32 in relation to the rotation direction of roller 30. Together with the inner surface of respective cavity 27, each roller 30 defines a curved rolling channel 34 of a width approximately equal to but no larger than the diameter of group 8. By virtue of roller 26 rotating about axis 5, and rollers 30 simultaneously rotating about respective axes 29 and in relation to roller 26, each group 8 transported by drum 3 between stations 7 and 12 travels precessionally along a substantially circular path P2 through stations 7 and 12.

Rollers 30 are rotated anticlockwise (in FIG. 1) about respective axes 29 by a power drive 35 comprising a fixed sun gear 36 coaxial with axis 5; a gear 37 integral with each roller 30; and an idle gear 38 interposed between gear 36 and each gear 37. Gear 36 and gears 37, 38 are so sized that, as roller 26 rotates about its axis 5, each roller 30 makes a finite number (two, in the example shown.) of full turns about its axis 29 as it travels between station 7 and station 12, and a further finite number (one, in the example shown) of complete turns about its axis 29 as it travels between station 12 and station 7.

Operation of machine 1 will now be described, for the sake of simplicity, with reference to one group 8 retained by suction by chamber 24 inside a seat 21 upstream from station 22 (in relation to the rotation direction of roller 19) and traveling towards station 7 at a substantially constant speed V1; and with reference to one roller 30, the axis 29 of which is fed by roller 26 towards station 7 at a speed V2 equal to speed V1 at station 7, roller 30 being rotated about its axis 29 by drive 35 at a surface speed V3, so that, at station 7, $V1=V2(1+r)-V3$, where "r" is the radius of roller 30.

As group 8 travels through station 22, it is applied with a respective strip 9 which, upstream from station 22, travels along a substantially circular path P3 tangent to path P1 at station 22, and is applied to group 8 as described previously, i.e. with its rear end contacting a generating line of group 8 opposite respective seat 21; and group 8 with respective strip 9 retained by respective element 23 are fed by roller 19 along path P1 to station 7.

Group 8 reaches station 7 simultaneously with suction seat 31 on roller 30, and, by cutting off suction through chamber 24, is drawn by suction into seat 31 with respective strip 9 directly contacting seat 31 and facing forward in the rotation direction of roller 26, but rearwards in the rotation direction of roller 30 in relation to roller 26.

A compressed air jet from chamber 25 is directed through respective element. 23 on to strip 9 immediately downstream from station 7, so that strip 9 adheres to the outer surface of roller 30 on which it is retained by suction through holes 33.

Figure 3:
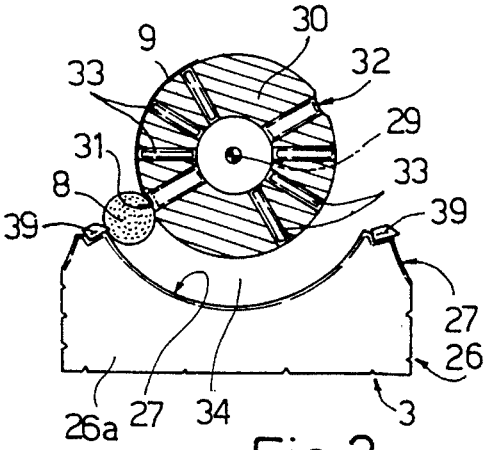
Figure 4:
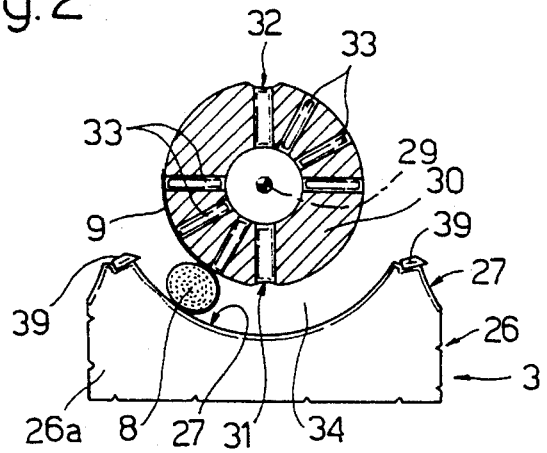
Figure 5:
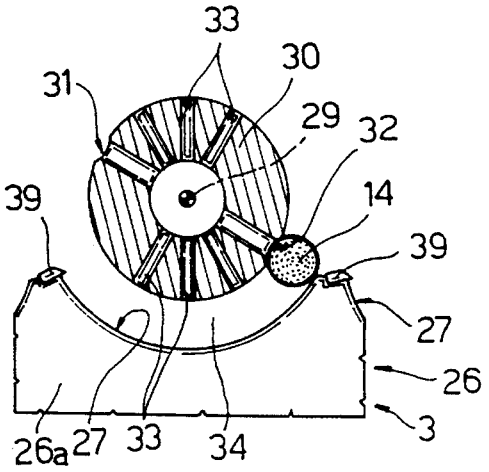

On receiving group 8 and respective strip 9, roller 30 continues rotating anticlockwise until it reaches the FIG. 3 position, wherein group 8 engages rolling channel 34 and, on contacting a tooth 39 at the input of channel 34, is detached from seat 31 and begins rolling between the surfaces of roller 30 and cavity 27 (FIG. 4) and along channel 34 at a traveling speed equal to half the surface speed of roller 30. As it does so, group 8, in the example shown, makes two full turns about its axis, and strip 9, formerly adhering by only one end to group 8, is wound about group 8 to connect the cigarette portions and the filter and so form a double filter-tipped cigarette 14. On reaching the FIG. 5 position at the output of channel 34, group 8 engages seat 32 diametrically opposite former seat 31.

Figure 6:
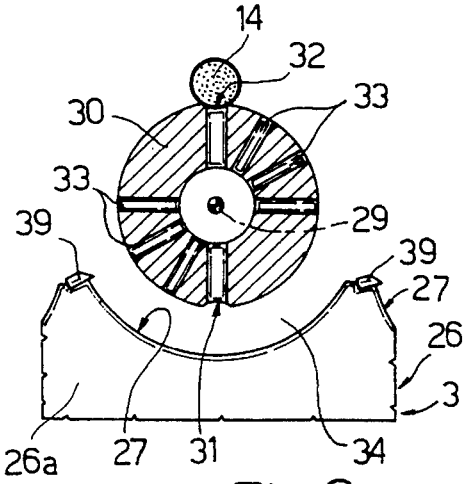

At this point, roller 30 continues to be rotated anticlockwise (in FIG. 1) by drive 35, and at the same time is fed by roller 26 to station 12 where the newly formed double cigarette 14 is positioned as shown in FIG. 6, and transferred in known manner to roller 10.

Positioning strips 9 so as to extend forwards in relation to respective groups 8 on roller 19 therefore provides for rotating rollers 30 in the opposite direction to roller 26, and so drastically reducing the resulting speed of seats 31 through station 7 and seats 32 through station 12, as compared with the speed V2 imparted by drum 3 to axes 29. As a result, the pitch of seats 13 and 21 is accordingly less than that of axes 29, thus reducing speed V1 for a given number of groups 8 fed per unit of time through station 7.

We claim:

1. A method of producing filter-tipped cigarettes, the method comprising stages of feeding, by means of an input conveyor and in a given direction along a first given path, a succession of groups, each comprising two cigarette portions, a double filter between the two cigarette portions, and a gummed strip connected integral with, along a generating line of, and projecting from, said group; and successively transferring said groups into respective seats on a rolling device; the rolling device feeding said seats along a second path tangent to the first path at a transfer station; and each said gummed strip being fed on to the respective group along a third path tangent to the first path, and in such a manner as to project frontwards from the group in said given direction.

2. A method as claimed in claim 1, further comprising a stage of retaining by suction the front portion of each said strip as the strip travels along said first path.

3. A method as claimed in claim 1, wherein the front portion of each said strip is removed pneumatically from said first path at said transfer station.

4. A method as claimed in claim 1, wherein said first path is circular.

5. A method as claimed in claim 4, wherein each said group is fed precessionally by the rolling device along said second path which is substantially circular.

6. A method of producing filter-tipped cigarettes, the method comprising stages of successively feeding respective transfer conveyors with groups, each comprising two cigarette portions, a double filter between the two cigarette portions, and a gummed strip connected integral with, along a generating line of, and projecting from, said group; winding each strip about the respective group by feeding the group along a respective rolling channel by means of the respective transfer conveyor moving at a first speed; and feeding each rolling channel along a given path at a second speed; each transfer conveyor presenting a seat for a respective said group; and each group being transferred into the respective said seat off an input conveyor substantially tangent to said path at a transfer station; each said gummed strip being fed on to the respective group so as to project frontwards from the group in the traveling direction of the input conveyor.

7. A method as claimed in claim 6, wherein said input conveyor is moved towards said transfer station at a third speed equal to said second speed, and differing from said first speed at the transfer station.

* * * * *